United States Patent [19]

Hilty et al.

[11] Patent Number: 4,673,153

[45] Date of Patent: Jun. 16, 1987

[54] CLOTHING SUSPENSION APPARATUS

[76] Inventors: Calvin A. Hilty, 16985 Ave. 192, Strathmore, Calif. 93267; Larry J. Raid, Denmark, Iowa 52624

[21] Appl. No.: 849,121

[22] Filed: Apr. 7, 1986

[51] Int. Cl.[4] ..... A47B 96/06

[52] U.S. Cl. ..... 248/231.8; 24/563; 248/229; 248/309.1

[58] Field of Search ..... 248/231.8, 316.7, 229, 248/309.1; 211/89, 30, 33, 32, 13; 223/120; 24/3 J, 3 L, 72.5, 455, 563, 545, 546

[56] References Cited

U.S. PATENT DOCUMENTS

| | | | |
|---|---|---|---|
| 845,739 | 3/1907 | Alson . | |
| 853,051 | 5/1907 | Alson . | |
| 1,257,406 | 2/1918 | Sauerman . | |
| 2,519,987 | 8/1950 | Wernette | 24/563 X |
| 2,765,509 | 10/1956 | Brehm | 24/563 X |
| 2,994,437 | 8/1961 | Nyitrai . | |
| 3,192,894 | 7/1965 | Staver | 248/312 X |
| 3,322,381 | 5/1967 | Bubb | 248/229 X |
| 3,393,888 | 7/1968 | Henningsgard . | |
| 3,521,332 | 7/1970 | Kramer | 248/229 X |
| 3,531,072 | 9/1970 | Lindquist | 248/316.7 X |
| 4,292,714 | 10/1981 | Walker | 24/563 X |
| 4,605,190 | 8/1986 | Kamp | 248/316.7 |

FOREIGN PATENT DOCUMENTS

| | | | |
|---|---|---|---|
| 74817 | 9/1952 | Denmark | 211/33 |

*Primary Examiner*—J. Franklin Foss

*Attorney, Agent, or Firm*—Worrel & Worrel

[57] ABSTRACT

A cap suspension apparatus for suspending a cap in a predetermined attitude. The apparatus includes a main body having dependent legs deployed in spaced relationship for engaging a button affixed on a cap's crown.

1 Claim, 5 Drawing Figures

CLOTHING SUSPENSION APPARATUS

BACKGROUND OF THE INVENTION

1. Field of the Invention

The present invention relates to an apparatus for suspending an article of clothing and the like from a supporting structure, and more particularly to an apparatus operable to deploy a plenary number of caps in an appropriate attitude to permit the brow portions thereof to be exposed for purposes of display.

2. Description of the Prior Art

In the last decade, it has become quite popular for businesses, and a variety of other organizations, to advertise their products or services by printing their group's slogans, lg trademarks, advertisements or messages onto the brow portion of lightweight, baseball-type caps and thereafter distribute, or sell these caps to their members or customers. This form of advertisement, for example, has become quite popular with respect to college and professional athletic teams, especially professional baseball and football franchises.

Recently, it has become quite popular for sports enthusiasts and others to collect these baseball caps, adorned with their asundry advertising slogans and designs, and thereafter to hold them for purposes of display. As should be understood, no convenient and inexpensive method has yet been devised to display these cap collections, apart from the obvious method of constructing shelves which are somewhat expensive to purchase and usually require time-consuming installation.

Attempts have been made in the prior art to manufacture devices operable to deploy various caps and assorted head wear for purposes of display or sale. For instance, several prior art patents have shown devices with frame-like members adapted to hold a derby-like hat in such a manner that the caps can be conveniently stacked within another on a display case for sale.

Other attempts in the prior art to provide devices adapted to deploy various garments, such as head wear, have included, for example, U-shaped, spring-biased hat rim engaging members which are operable to engage the hat rim and thereby cause the deployment of the remainder of the cap in an appropriate attitude.

While some of the prior art devices have operated with varying degrees of success, they are unsatisfactory in one or more respects. For example, some of these devices are cumbersome, are difficult to retain in position, and do not admit to convenient, easy employment in confined quarters, for instance. Others, either do not admit to convenient deployment of baseball-type caps or are otherwise over-sized and unsightly in use. Furthermore, some of these devices can only be employed by the use of a permanent fixture or specially-adapted mounting mechanism. Yet another deficiency common in the prior art devices is their obvious inability to be manufactured and sold at a relatively inexpensive price.

Therefore, it has long been known that it would be desirable to have an apparatus capable of deploying a cap in an appropriate attitude for the purpose of exposing the brow portion thereof for display, and which is capable of performing a variety of other useful functions, the device being both inexpensive to manufacture and to sell and capable of relatively easy usage and installation.

OBJECTS AND SUMMARY OF THE INVENTION

Therefore, it is an objective of the present invention to provide an improved apparatus for suspending articles of clothing and the like.

Another object is to provide an apparatus which is operable to obtain the benefits derived from a cap suspension apparatus while avoiding the detriments individually associated therewith.

Another object is to provide an apparatus having a main body and dependent legs which are adapted to engage and thereafter deploy a cap in an appropriate attitude.

Another object is to provide an apparatus which is adapted to capture a button affixed to the crown of a cap and which can be detachably secured in capturing relation thereto.

Another object is to provide an apparatus which can be slidably affixed to a suitable support member for easy deployment in a number of different environments.

Another object is to provide an apparatus which is operable to permit the deployment of a plenary number of caps in stacked, juxtapositioned relationship, for purposes of display.

Another object is to provide an apparatus which is characterized by ease of deployment, simplicity of construction and which can be sold at a nominal price.

Further objects and advantages are to provide improved elements and arrangements thereof in an apparatus for the purposes described which is dependable, economical, durable and fully effective in accomplishing its intended purposes.

These and other objects and advantages are achieved in an improved clothing suspension apparatus peculiarly adapted to deploy a plenary number of caps wherein a main body having dependent legs, is deployed therebetween the cap's crown, and a button affixed to the cap's crown, for the purpose of suspending the cap in a preselected attitude.

DESCRIPTION OF THE PREFERRED EMBODIMENT

Figure 1:
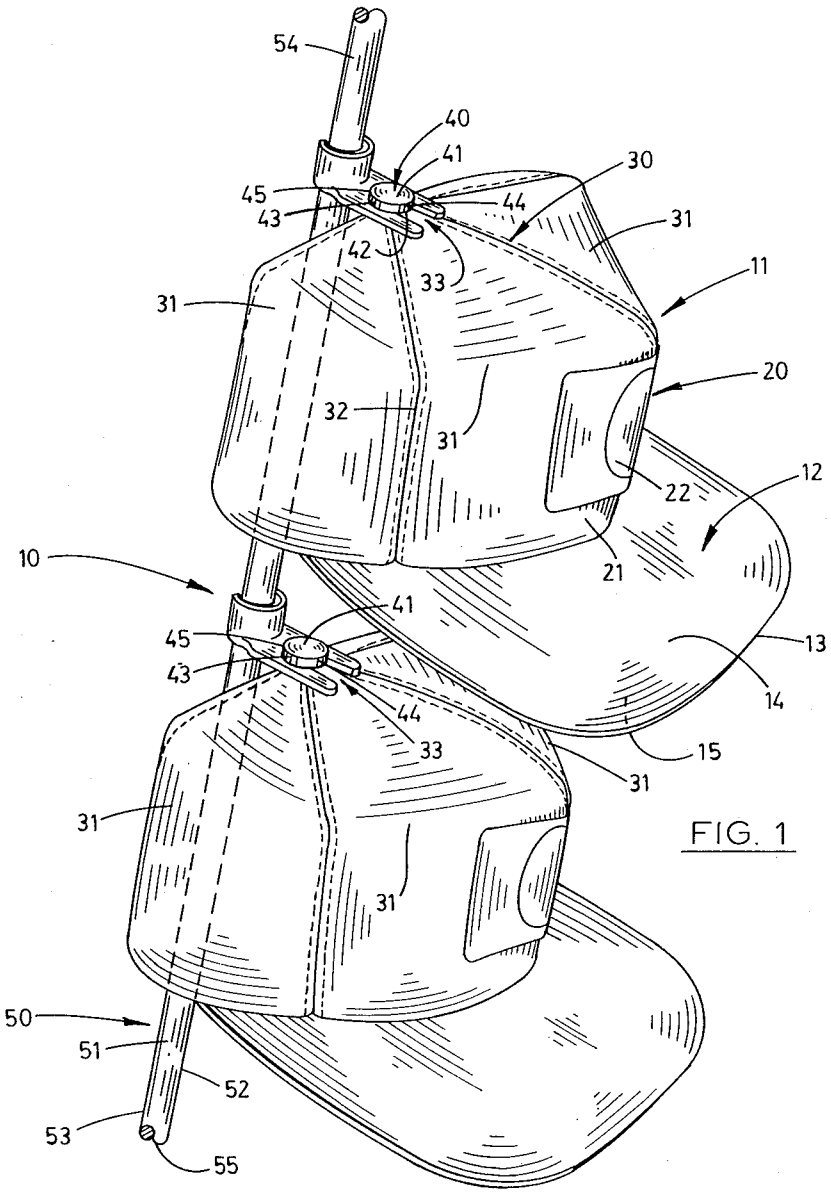
FIG. 1 is a perspective side elevational view of the apparatus embodying the principles of the present invention in a typical, operative environment.

Referring more particularly to the drawings, the apparatus embodying the principles of the present invention is designated generally by the numeral 10 in FIG. 1. As shown therein, the apparatus is operable to deploy an appropriate cap or hat 11 in a preselected attitude.

For illustrative convenience only, the clothing suspension apparatus, as shown and described herein, will be discussed as it would be configured if it was installed in a private residence. However, it should be understood that the apparatus can be deployed in a wide variety of different settings, for purposes of commercial exploitation, or for mere display.

As will hereinafter thus be described in greater detail, the clothing suspension apparatus 10 is operable for installation in either a private home, or a commercial setting, such as indicated fragmentarily at 10 in FIG. 1.

The cap 11 has a brim or visor 12. The brim has a marginal edge 13, a top surface 14, and a correspondingly opposed bottom surface 15. The brim is preferably constructed of a flexible material which has a lightweight fabric stretched thereover, such as cotton, nylon or the like.

The cap 11 has a brow which is generally indicated by the numeral 20. The brow of the cap has a central portion 21, upon which it has been customary to print a suitable advertising logo or message, or as illustrated in FIG. 1, suitably affix a patch-like device, here indicated by the numeral 22. As can best be imagined by a study of FIG. 1, it should be understood that the cap is folded inwardly in a predetermined manner to permit it to be appropriately deployed.

The cap 11 has a crown portion 30. The crown portion is composed of several panels of lightweight fabric or fabric-like material 31 which have been cut to an appropriate shape and thereafter joined together at several seams 32. The several seams converge at an intersection point 33 which is substantially centrally located on the crown portion.

Joining the several converging panels of material 31 together at the intersection point 33 is a button, which is generally indicated by the numeral 40. The button is of conventional design, having a top surface 41 and an opposed, bottom surface 42. The button has a circumscribing edge, generally indicated by the numeral 43.

As can best be seen by reference to FIG. 1, the apparatus of the subject invention is operably deployed from an appropriately configured support member 50. The support member, as illustrated, has a surface 51, and is deployed in a substantially vertical attitude. When the support member is appropriately mounted, its surface has a forward facing portion 52 and an opposed, rearward facing portion 53. The support member has a first end 54 and an opposed, second end 55 which are affixed to any number of a variety of different fixtures, which are not shown but which can maintain the support member in a vertical attitude.

Figure 2:
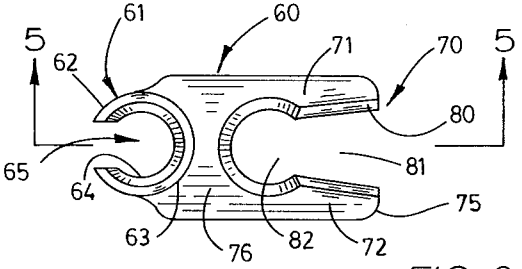
FIG. 2 is a top plan view of the apparatus in a nondeployed configuration.
Figure 3:
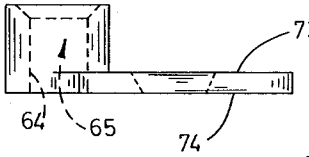
FIG. 3 is a side elevational view of the apparatus of FIG. 2, with the underlying structure of the apparatus indicated in phantom lines.

The apparatus 10 of the subject invention is best understood by reference to FIG. 2. As shown therein, the apparatus has a main body, or button engagement member, generally indicated by the numeral 60. Formed about one end of the main body is an attachment member 61 which is configured in the shape of a ring-like, non-continuous wall 62. The main body, and the attachment member, are manufactured of a resilient material, such as fiberglass or any of the numerous plastics which are commonly used with plastic molding equipment. The attachment member has an outside surface 63 and a correspondingly opposed inside surface 64. As is best understood by reference to FIG. 3, the inside surface of the attachment member defines an annular opening or orifice 65 which is conformably dimensioned to slidably engage, and thereafter closely hold in mating relationship, an appropriately configured support member 50. As should be understood by all those skilled in the art, the attachment member of the subject apparatus can take on a variety of different shapes which would correspond to the configuration of different support members from which it may be deployed and made operational.

As presently conceived, the dimensions of the orifice 65 permits the apparatus 10 to be slidably deployed, and thereafter held in an appropriate attitude along the length of the support member 50, by the effect of friction which is created between the inside surface 64 of the attachment member 61 and the surface 51 of the support member. Those skilled in the art should recognize, however, that the attachment member can be held in an appropriate attitude, alternatively, by a number of different attachment means, such as by a screw, glue, staple, nail, or the like, and therefore the apparatus should not be limited to that embodiment which is depicted in the drawings.

Figure 4:
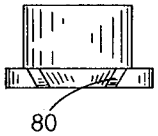
FIG. 4 is a front elevational view of the apparatus of FIG. 2.
Figure 5:
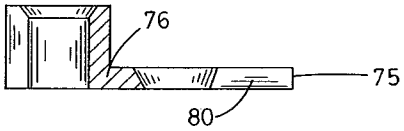
FIG. 5 is a fragmentary longitudinal vertical section of the subject apparatus taken on line 5—5 in FIG. 2.

The main body 60 has a pair of dependent legs 70 which are deployed in relatively fixed, spaced relationship for the purpose of slidably engaging the button 40 which is affixed on the crown 30 of a cap 11. The pair of dependent legs have a first leg 71 and a second leg 72. As best seen by reference to FIG. 3, the pair of dependent legs has a top surface 73 and an opposed, bottom surface 74. As can best be appreciated by reference to FIG. 2, the dependent legs have a leading portion 75 and a trailing portion 76. The pair of dependent legs, as illustrated in FIG. 4, have an edge-like, internal surface 80. The edge-like internal surface defines a diminishing and substantially U-shaped slot 81, which permits the dependent legs slidably to receive and capture the button in substantially fixed relationship between the dependent legs. When properly put to use, the apparatus is deployed therebetween the cap's crown and the bottom surface 42 of the button affixed on the cap's crown.

Upon reference to FIG. 2, it will be seen that the pair of dependent legs 60 converge to form a diminishing annular bore 82 which is centrally disposed of the main body 60. As is best illustrated in FIG. 1, the annular bore is dimensioned suitably to receive and capture the button affixed on the crown 30 of a cap 11. As should be appreciated, the overall length of the main body is somewhat dependent upon the support member 50 to which it is mounted. Those skilled in the art should recognize that in the event that the apparatus was deployed from, for example, a flat surface, the main body would be somewhat longer in length than that depicted in FIGS. 2 through 5. Moreover, as was stated earlier, the shape of the attachment member 61 can be varied to correspond with the configuration of the support member 50.

OPERATION

The operation of the described embodiment of the subject invention is believed readily apparent and is briefly summarized at this point.

The apparatus 10 for suspending an article of clothing, such as a cap 11, is shown in FIG. 1, in its preferred embodiment. The apparatus, as depicted, is suitably employed along a support member 50, here illustrated as a tubular-configured pole. The apparatus has a main body 60, and an attachment member 61, which is formed about one end of the main body. The attachment member is configured in the shape of a ring-like, non-continuous wall 62 which is conformably dimensioned to permit the attachment member to slidably mate with the support member. A plenary number of apparatuses are spaced a predetermined distance along the length of the support member to permit the caps to be stacked in juxtapositioned relationship. As is best imagined by reference to FIG. 1, the cap is folded in an appropriate manner to permit it to be held in a desirable attitude by the apparatus.

The apparatus 10 has a main body or button-engagement member 60 which has formed therein a centrally disposed, diminishing annular bore 82. The main body has a pair of converging, dependent legs 70 which defines a diminishing and substantially U-shaped slot 81, dimensioned suitably to slidably receive a button 40 that is affixed to the crown 30 of the cap 11. As is best understood by reference to FIG. 1, the bottom surface 42 of the button 40 lies in contact with the top surface 73 of the main body 60. Thus, it should be apparent that the main body of the apparatus is slidably received between the bottom of the button and the crown of the cap.

The apparatus 10 of the present invention can be adapted for installation on a wide variety of different support members 50. In addition, the apparatus can be modified to permit its use on other surfaces, such as a wall. The apparatus is easily installed and maintained, and can be manufactured at a nominal price as compared with other prior art devices used for similar purposes.

Although the invention has been herein shown and described in what is conceived to be the most practical and preferred embodiment, it is recognized that departures may be made therefrom within the scope of the invention, which is not to be limited to the illustrative details disclosed.

Having thus described and illustrated our new invention, what we claim as new and desire to secure by Letters Patent is:

1. A cap suspension apparatus for supporting and displaying a cap having a front portion and additionally having a button affixed on a crown thereof by an interconnection, the apparatus comprising a tubular support member adapted to be disposed in a substantially vertical attitude; and at least one button engagement assembly having an attachment member and a pair of dependent legs, said attachment member being dimensioned slidably to engage and by the effect of friction hold in mating relation the engagement assembly on said support member, and the dependent legs having edge-like internal surfaces defining an inwardly convergent slot communicating with an annular bore and said legs dimensioned to be slidably moved between the button and the crown of the cap and on opposite sides of the interconnection between the button and crown and into supporting relation to the cap for retaining the cap in supported relation on the support member for displaying said front portion thereof.

* * * * *

UNITED STATES PATENT AND TRADEMARK OFFICE

CERTIFICATE OF CORRECTION

PATENT NO. : 4,673,153

DATED : June 16, 1987

INVENTOR(S) : Calvin A. Hilty and Larry J. Raid

It is certified that error appears in the above-identified patent and that said Letters Patent is hereby corrected as shown below:

Column 1, line 17, before "trademarks" delete "lg".

Signed and Sealed this

Third Day of November, 1987

*Attest:*

DONALD J. QUIGG

*Attesting Officer*

*Commissioner of Patents and Trademarks*